US007708589B2

(12) United States Patent
Shuey

(10) Patent No.: US 7,708,589 B2
(45) Date of Patent: May 4, 2010

(54) PANEL-MOUNT CONNECTORS WITH LATCHING FEATURES

(75) Inventor: Joseph B. Shuey, Camp Hill, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/059,119

(22) Filed: Mar. 31, 2008

(65) Prior Publication Data

US 2008/0318461 A1 Dec. 25, 2008

Related U.S. Application Data

(60) Provisional application No. 60/945,603, filed on Jun. 22, 2007.

(51) Int. Cl.
*H01R 13/74* (2006.01)

(52) U.S. Cl. ..... 439/552

(58) Field of Classification Search ..... 439/552, 439/557, 345, 353; 174/65 R, 65 G
See application file for complete search history.

(56) References Cited

U.S. PATENT DOCUMENTS

| | | | | |
|---|---|---|---|---|
| 3,052,865 | A | 9/1962 | Pappano et al. | |
| 5,279,507 | A * | 1/1994 | Kameyama | 439/552 |
| 5,800,208 | A * | 9/1998 | Ishizuka et al. | 439/557 |
| 6,089,909 | A * | 7/2000 | Tokuwa | 439/557 |
| 6,210,217 | B1 * | 4/2001 | Ping | 439/557 |
| 6,402,554 | B1 * | 6/2002 | Yeh | 439/607 |
| 7,060,900 | B1 * | 6/2006 | Gretz | 174/652 |
| 7,137,847 | B2 | 11/2006 | Trout et al. | |
| 7,168,978 | B1 | 1/2007 | Trout et al. | |
| D556,141 | S | 11/2007 | Whiteman, Jr. et al. | |

* cited by examiner

*Primary Examiner*—Alexander Gilman
(74) *Attorney, Agent, or Firm*—Woodcock Washburn LLP

(57) ABSTRACT

An electrical connector assembly is provided for mounting onto a panel having a panel opening. The connector assembly includes a connector and a latch. The latch is configured to mount on the connector, and attach to the panel as the housing is inserted into the opening.

21 Claims, 11 Drawing Sheets

PANEL-MOUNT CONNECTORS WITH LATCHING FEATURES

CROSS REFERENCE TO RELATED APPLICATIONS

This claims priority to U.S. Provisional Patent Application No. 60/945,603, filed Jun. 22, 2007, the disclosure of which is hereby incorporated by reference as if set forth in its entirety herein.

BACKGROUND

The present invention relates generally to electrical connectors, and in particular to electrical connectors having latching features that facilitate mounting of the electrical connectors on panels.

Panel mount connectors are conventionally mounted to panels using fasteners such as brackets, clamps, bolts, or screws that form a mechanical connection between a given connector and the associated panel. These types of fasteners typically increase the overall footprint of the electrical connector, and can necessitate spacing between adjacent connectors substantially greater than that which would otherwise be required. The conventional fasteners can also necessitate multiple assembly steps to mount the connector on the associated panel.

SUMMARY

In accordance with one aspect of the present invention, an electrical connector assembly is configured to be mounted on a panel. The electrical connector assembly comprising an electrical connector having a connector housing, and a latch configured to be mounted on the housing. The latch further includes an engagement member configured to engage the panel as the housing is initially inserted through a panel opening. The latch translates in relation to the housing as the housing is further inserted through the panel opening after the engagement member has engaged the panel.

DETAILED DESCRIPTION OF ILLUSTRATIVE EMBODIMENTS

Figure 1:
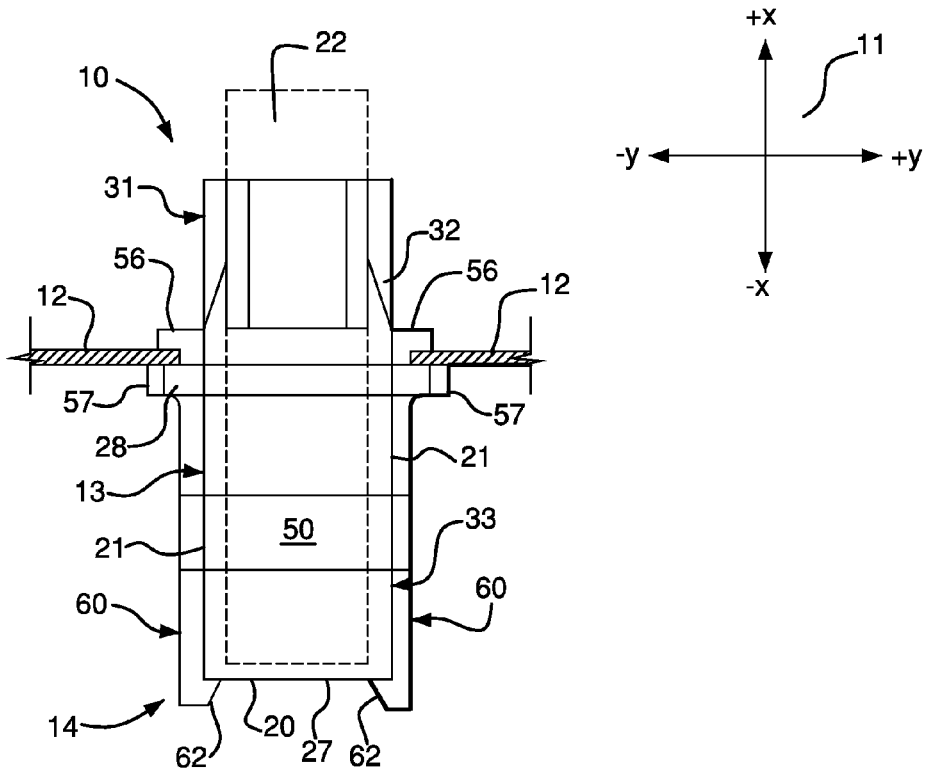
FIG. 1 is a top view of an electrical connector assembly including an electrical connector and a latch constructed in accordance with aspects of the present invention, with the connector assembly mounted on a panel and the latch in a fully-installed configuration.
Figure 2:
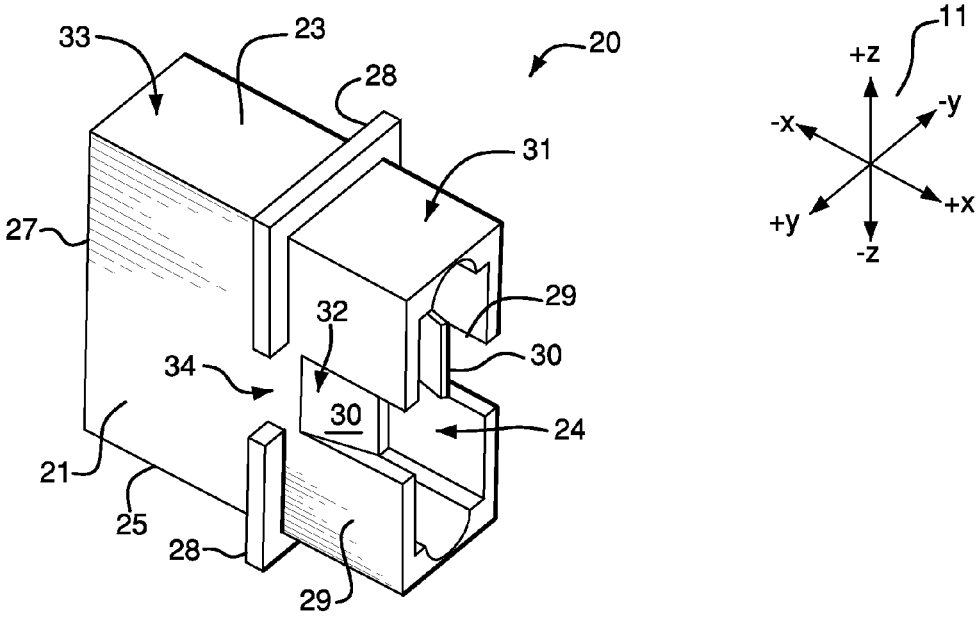
FIG. 2 is a front perspective view of a housing of the electrical connector shown in FIG. 1.

Referring to FIGS. 1 and 2, an electrical connector assembly 10 includes an electrical connector 13 and a latch 14 that is configured to attach to the connector 13 and to a panel 12 to mount the connector 13 onto the panel 12. While the connector 13 is illustrated as a header connector, though it should be appreciated that the principles of the present invention can apply to other types of panel-mount connectors, including panel-mount receptacle connectors. The connector assembly 10 and its components are described herein with reference to a common coordinate system 11, including a horizontal x-axis, a horizontal y-axis, and a vertical z-axis. The x-axis is also said to illustrate a front-to-back direction, the y axis is also said to illustrate a side-to-side direction, and the z-axis is also said to illustrate an up-and-down direction. Directional terms such as "top," "bottom," "above," "below," "in front of," "behind," and the like, are used with reference to the illustrated component orientations. These terms are used for illustrative purposes only, and are not intended to limit the scope of the appended claims.

The connector 13 can include an electrically insulative housing 20 that can be formed from plastic using an injection molding process, or can alternatively be formed using other types of materials and processes. The housing 20 is rectangular as illustrated, but can assume any desired size and shape configured to mount onto the panel in accordance with certain aspects of the present invention. As illustrated, the housing 20 includes opposing side walls 21, and an opposing upper wall 23 and base 25 that join the upper and lower ends of the side walls, respectively. A rear end wall 27 can connect to the side walls 21, upper wall 23, and base 25, respectively. The walls 21, 23, and 27, and base 25, define a front opening to an internal cavity 24 configured to receive a contact 22 that is supported by the housing 20. The contact 22 can be, for instance, a power contact or any other desired electrical contact.

The housing 20 of the connector 13 can further include a lip 28 that extends around the outer circumference of the housing 20. As illustrated, the lip 28 projects out from the upper wall 23, base 25, and side walls 21. The lip 28 can be discontinuous to define a pair of opposing vertically elongate and aligned notches 34 that extend through the lip 28 at both side walls 21. The lip 28 can be said to divide the housing 20 into a forward portion 31 that extends forward from the lip 28, and rear portion 33 that extends rearward from the lip 28. The rear portion 33 can also include that portion of the housing 20 that is vertically aligned with the lip 28.

The housing 20 can also include a pair of pockets 29 formed in the opposing side walls 21. For instance, the pockets 29 can be rectangular and extend rearward from the front ends of side walls 21. The pockets 29 can terminate prior to the lip 28, and can be vertically aligned with the notches 34 formed in the lip 28. The pockets 29 can further define a height substantially equal to the height of the notches 34.

A guide member, such as an angled guide wall 30 can further be provided and juxtaposed with each pocket 29. As illustrated, each guide wall 30 can attach to the corresponding side wall 21 at the rear vertical edge of the pocket 29, and can extend forward and inward into the cavity 24. The guide walls 30 can thus be angled with respect to the side walls 21. The guide walls 30 define recesses 32 in the pockets 29 that can guide the latch 14 through the notches 34 into a desired position as the housing 20 is mounted on the panel 12, as will be described in more detail below.

Figure 3:
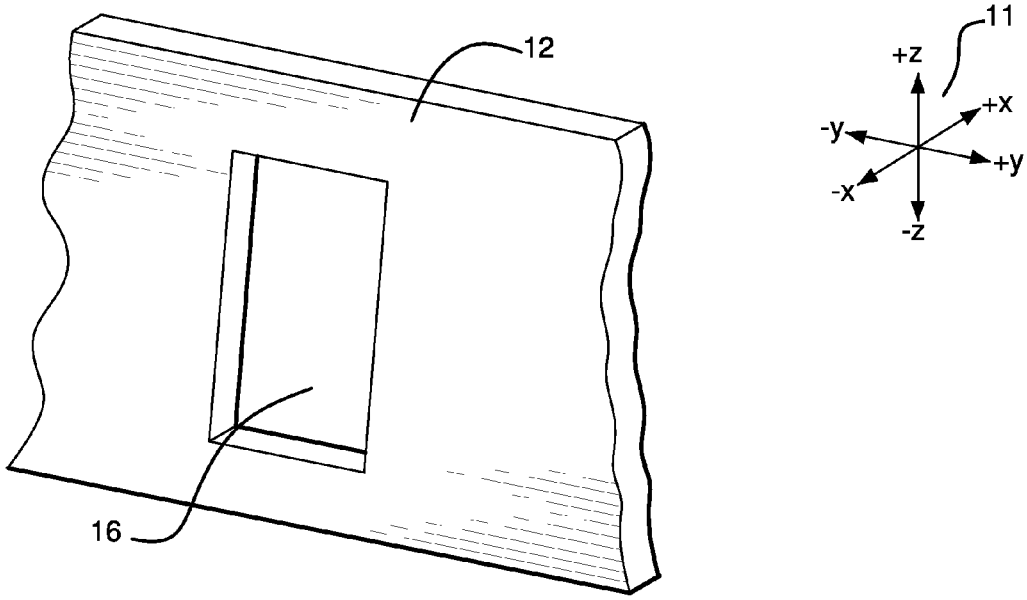
FIG. 3 is a perspective view of the panel illustrated in FIG. 1.

Referring now to FIG. 3, the panel 12 can be provided as any support structure capable of supporting the connector assembly 10 when mounted onto the panel. As illustrated, the panel can include an opening 16 that extends through the panel 12 and is configured to receive the connector assembly 10. The opening 16 can correspond generally to the shape of the outer circumference of the housing 20 (rectangular in the illustrated embodiment), and can be sized slightly greater than the perimeter of the front portion 31 of the housing 20.

Figure 4:
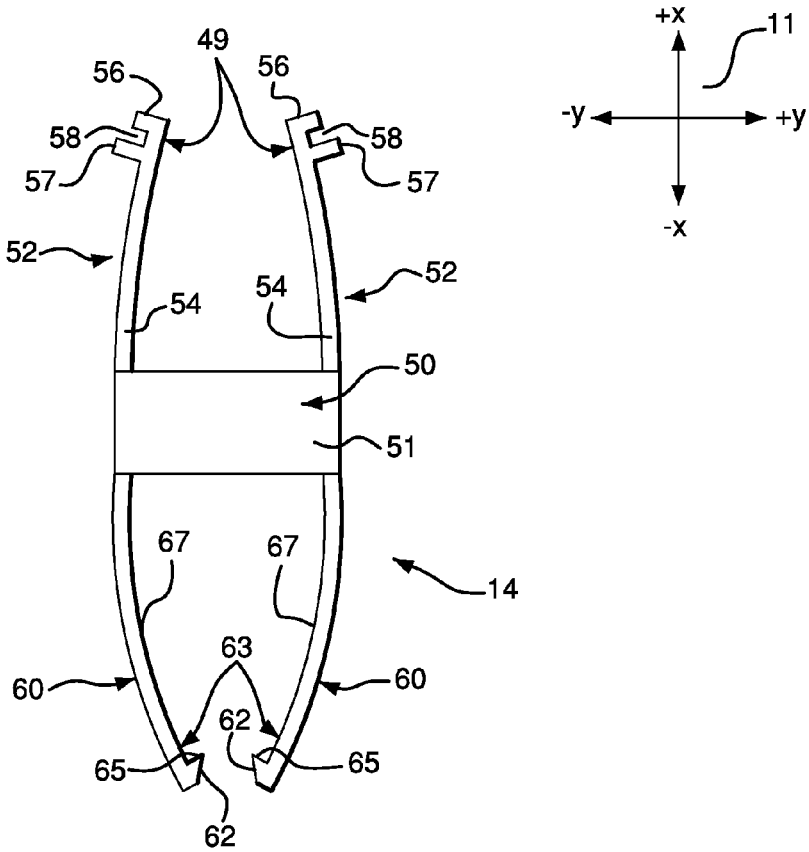
FIG. 4 is a top plan view of the latch illustrated in FIG. 1.
Figure 5:
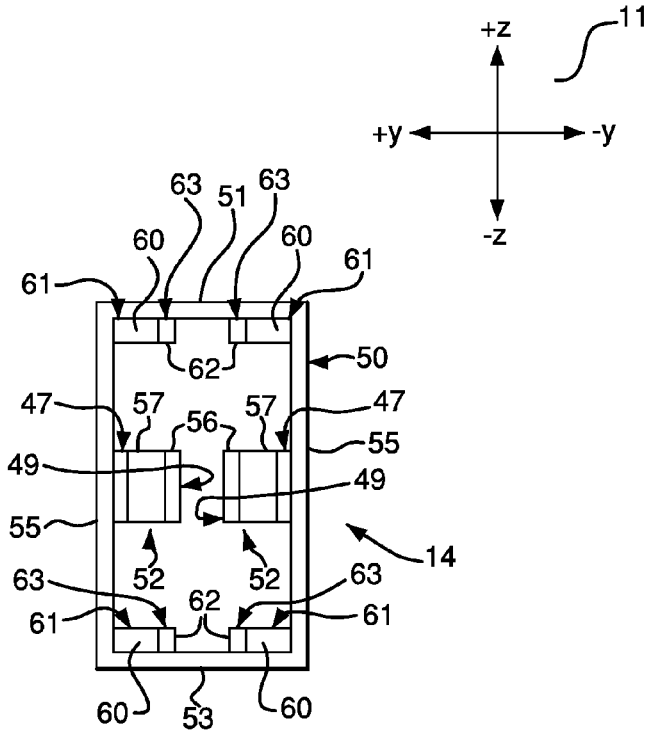
FIG. 5 is a front elevation view of the latch illustrated in FIG. 4.
Figure 6:
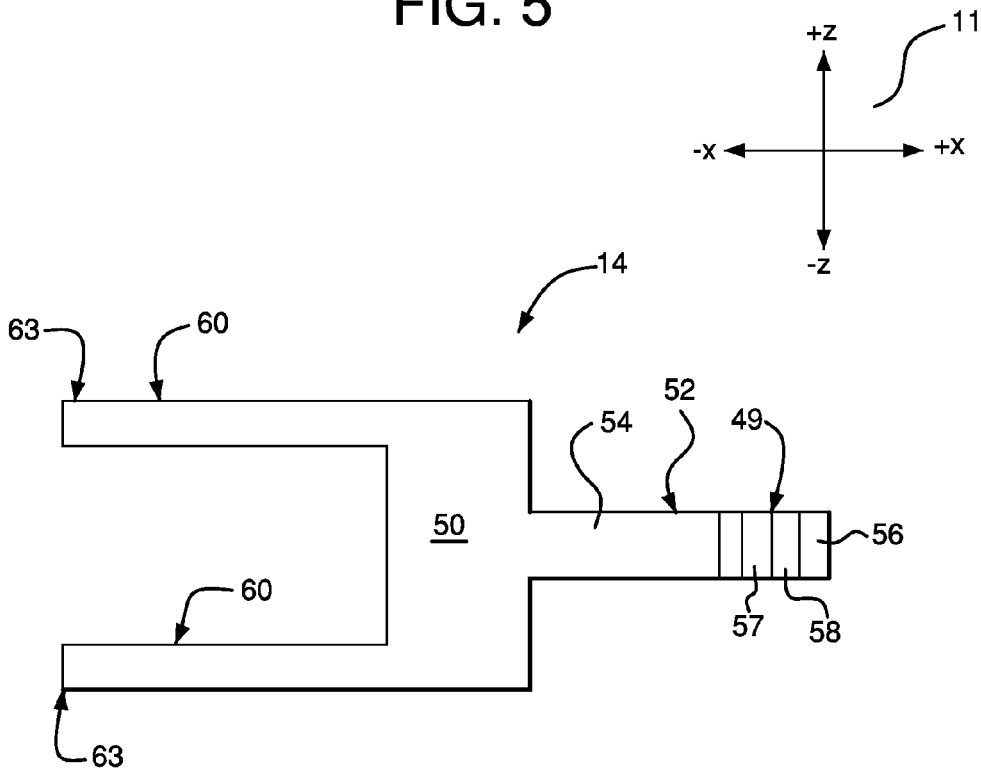
FIG. 6 is a side elevation view of the latch illustrated in FIGS. 4-5.

Referring now to FIGS. 4-6, latch 14 can insulative, and formed from plastic using an injection molding process, or can alternatively be formed using other types of materials and processes. The latch 14 includes a substantially rectangular latch band 50, first latch arms 52 that extend forward from the band 50, and second latch arms 60 that extend rearward from the band 50. The latch 14 constructed in accordance with the illustrated embodiment includes a pair of first latch arms 52 and two pairs of second latch arms 60.

The band 50 includes a pair of opposing upper and lower walls 51 and 53 that define a width ("y" dimension) of the band 50 that is approximately equal to the corresponding width of the connector housing 20. The band further includes a pair of opposing side walls 55 that are connected at their upper and lower ends to the upper and lower walls 51 and 53, respectively. The side walls 55 define a height ("z" dimension) of the band 50 that is approximately equal to the corresponding height of the housing 20. The band 50 is therefore configured to fit snugly around the housing 20.

The first latch arms 52 define rear proximal ends 47 that are connected to the opposing side walls 55, and front distal ends 49 disposed opposite the proximal ends 47, and a main portion 54 extending between the proximal and distal ends 47 and 49, respectively. The main portions 54 of the first latch arms 52 extend forward from the opposing side walls 55, and can be sloped, and thus curve or otherwise extend toward each other in a direction of travel away from the latch band 50. The distal ends 49 are thus disposed inward with respect to the proximal ends 47 when the band 50 is in a relaxed, or unconstrained, state. The latch arms 52 can extend from the side walls 55 at a location such that the arms are aligned with the pockets 29 when the latch band 50 is mounted onto the housing 20. In the illustrated embodiment, the latch arms 52 extend from the vertical midpoint of the side walls 55.

The distal end 49 of each latch arm 52 can be F-shaped, and include a first projection 56 that extends out from the distal end 49, and a second projection 57 that extends out from the distal end 49. The projections 56 and 57 can extend out from the distal end 49 at any angle, and are substantially perpendicular to the distal end 49 as illustrated. The first projection 56 is forwardly spaced with respect to the second projection 56 such that a gap 58 is defined between the projections 56 and 57. The projections 56 and 57 thus provide an engagement member in the form of a catch defined by the gap 58 that is configured to engage the panel 12 when the connector assembly 10 is mounted on the panel 12. The first projection 56 can be shorter than the second projection 57, such that the first projection 56 extends out from the distal end 49 a distance less than that of the second projection 57. While the projections 56 and 57 are illustrated as extending out from the distal end, it should be appreciated that the projections 56 and 57 can alternatively extend out from any location along the latch arms 52 to facilitate attachment of the connector assembly 10 to the panel 12.

With continuing reference to FIGS. 4-6, the latch 14 can further include two pairs of second arms 60. Each pair second latch arms 60 includes a front proximal end 61 that is connected to the opposing side walls 55 of the latch band 50, and a rear distal end 63 disposed opposite the proximal end 61, and a main portion 67 extending between the proximal and distal ends 61 and 63, respectively. The main portions 67 of the second latch arms 60 extend rearward from the opposing side walls 55, and can be sloped, and thus curve or otherwise extend toward each other in a direction of travel away from the latch band 50. The distal ends 63 are thus disposed inward with respect to the proximal ends 61 when the band 50 is in a relaxed configuration. The distal end 63 of each arm 60 can include a projection 62 that forms the rearward end of the arm 60. The projection 62 provides an engagement member configured to mate with the connector housing 20. The projection 62 can include a forward clip surface 65 that extends substantially perpendicular to the distal end 63, and is thus configured to engage and seat against the rear end wall 27 of the housing 20 when the latch 14 is mounted onto the connector 13. While the projection 62 is illustrated as extending out from the distal end, it should be appreciated that the projection 62 can alternatively extend out from any location along the latch arms 60 to facilitate attachment between the latch 14 and the housing 20.

Each arm 60 of a given pair of arms 60 can be vertically aligned with each other, while each pair of arms can be vertically offset with respect to each other. For instance, as illustrated, a first pair of arms 60 can adjoin the latch band 50 proximate the top of the band 50, while a second pair of arms 60 can adjoin the latch band 50 proximate the bottom of the band 50.

Figure 7:
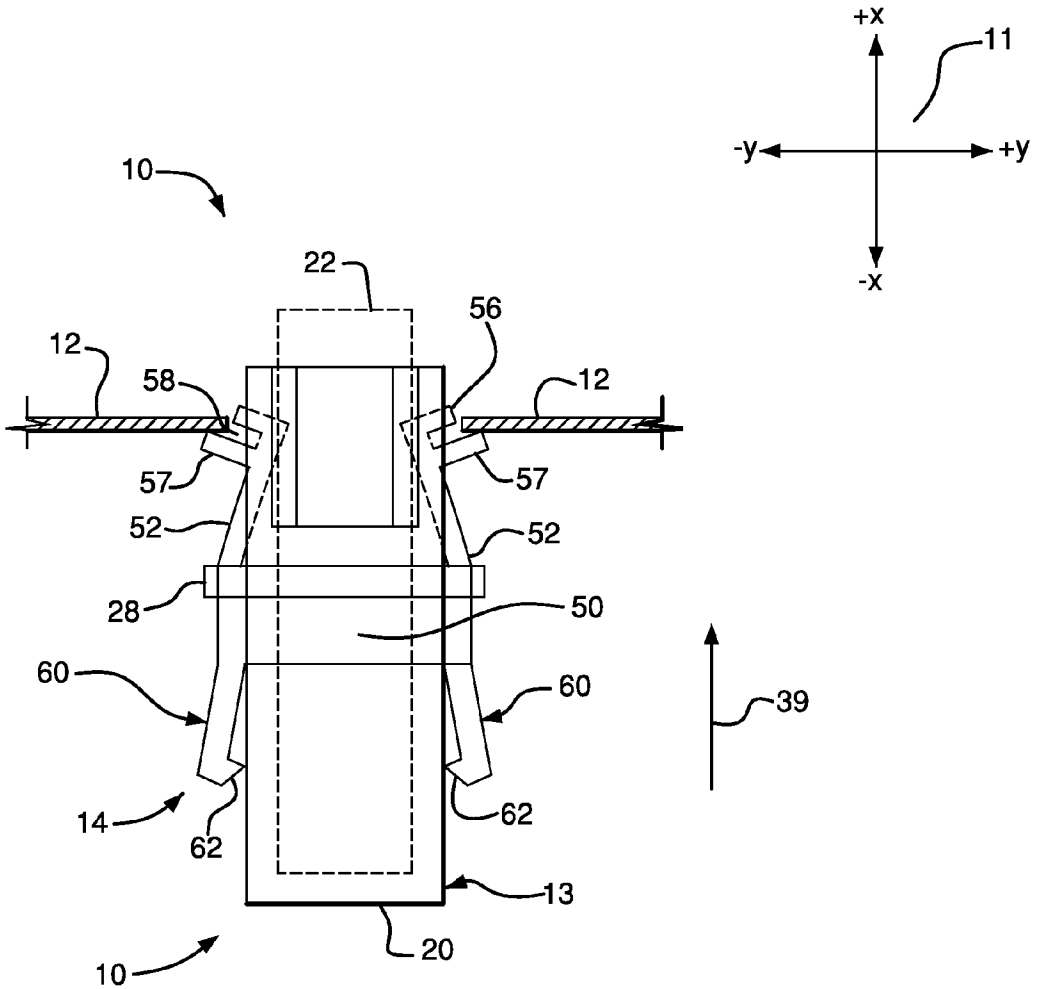
FIG. 7 is a top plan view of the electrical connector assembly illustrated in FIG. 1, showing the electrical connector mounted on the panel and the latch in a pre-load configuration.

Referring now to FIG. 7, the connector assembly 10 can be mounted onto the panel 12 by first positioning the latch 14 on the housing 20 in an initial, or "pre- oad" position. The latch 14 is positioned in its pre-load position on the housing 20 by placing the latch 14 behind the connector 13, and substantially aligning the band 50 with the outer periphery of the housing 20. The latch 14 is then moved in the forward, i.e., in the "+x" direction, toward the housing 20. The inwardly-curved arms 52 can be urged outwardly, i.e., away from each other, by hand, so that the housing 20 can initially be inserted between the arms 52. The latch 14 can then be urged further toward the housing 20 so that the band 50 receives the housing 20 to mount the latch 14 onto the housing 20.

The latch 14 can be further translated in the forward direction with respect to the housing 20 until the band 50 contacts the lip 28 of the housing 20, thereby preventing further forward movement of the latch 14 in relation to the housing 20. When the latch 14 is attached to the housing, the first arms 52 are extend forward from the latch band 50 so that each arm 52 is substantially aligned with, and is received by a respective one of the recesses 32 formed in the housing 20. The arms 52 can further extend through the notches 34 that are defined by the lip 28.

Once the latch 14 has been placed in its pre-load position on the housing 20, the connector assembly 10 can then be mounted onto the panel 12. In particular, the connector 13 is positioned behind the panel 12, and is aligned with the opening 16 in the panel 12. The connector 13 can then be initially moved toward the panel 12, in the forward direction as denoted by the arrow 39 in FIG. 7. The first projections 56 of the latch arms 52 are aligned to fit through the opening 16, while the longer second projections 57 are aligned with the panel 12 and catch the edge of the panel 12 proximate the opening 16 as the arms 52 reach the panel 12. The edge of the panel 12 is therefore in alignment with the catch 58 of each latch arm 52. The interference between the projection 57 and the panel 12 prevents the latch 14 from being further inserted through the opening 16.

Because the latch arms 52 can have a length that is shorter than that of the front portion 33 of the housing 20, the front portion 33 of the housing 20 can pass through the opening 16 when the projection 57 engages the panel 12. Alternatively, the latch arms 52 can be longer than the front portion 33 of the housing 20, such that the front portion 33 does not extend through the opening 16 when the projection 57 first engages the panel 12.

When the latch 14 is engaged with the panel 12, further forward movement of the housing 20 in relation to the panel 12 causes the latch 14 to slide rearward in relation to the housing 20. As the housing 20 is moved forward in relation to the panel 12, the distal ends 49 of the arms 52 ride along the angled guide walls 30 of the housing 20. The orientation of the surfaces 30 causes the distal ends 49 of the arms 52 to move outwardly, i.e., away from the housing 20, so that the edges of the panel 16 aligned with the arms 52 are captured by, i.e., become disposed within, the associated gap 58 between the first and second projections 56, 57 of the arms 52.

Continued movement of the housing 20 in the forward direction eventually causes the lip 28 of the housing 20 to contact the panel 12. Interference between the lip 28 and the panel 12 prevents further forward movement of the connector 13. It should be appreciated that the lip 28 need not surround the circumference of the housing 20, and that lip segments 28 extending from any of the side walls 21, upper wall 23, and base 25, would prevent further forward movement of the housing 20 through the opening 16.

The arms 60 are configured with a length sized so that that the projections 62 thereof reach the rear end wall 27 edge of the housing 20 at approximately the same time the lip reaches the panel 12. The resilience of the arms 60 causes the projections 62 to move inwardly once the projection 62 have cleared the rearward edge of the housing 20, as shown in FIG. 1. Interference between the clip surface 65 of each projection 62 and the rear wall 27 secures the latch 14 to the housing 20, and prevents movement of the housing 20 in the rearward direction. Because the engagement between the housing lip 28 and the panel 12 further prevents movement of the housing 20 in the forward direction, the housing 20 is thus captured between the panel 12 and the projections 60, so that the connector 13 is secured to the panel 12 with no substantial float, i.e., movement in the forward and rearward directions, between the connector 13 and the panel 12 after the connector 13 has been mounted on the panel 12.

The connector 13 can be removed from the panel by flexing arms 60 outward away from the housing 20 until the projections 62 become disengaged from the rear wall 27. The housing 20 can then be moved rearward through the latch 14. The latch 14 can be disengaged from the panel 12 by flexing arms 52 toward each other to remove the interference between the first 56 projection and the panel 12, at which point the first projections 56 fit through the panel opening 16 as the latch is moved rearward.

The number and relative positions of the arms 52 and the arms 60 can be altered from that described herein in alternative embodiments. The latch arms 52 and 60 do not have to be arranged as opposing, identical pairs as in the latch 14, and the number of arms 52 on each side of the latch 14 can be equal. Alternatively, at least one latch arm 52 can be provided and configured to attach to the panel 12, while the other side of the housing 20 can be press-fit into the opening or otherwise attached to or supported by the panel 12. Likewise, though four latch arms 60 have been described in conjunction with the illustrated embodiment, it should be appreciated that at least one latch arm 60, and alternatively at least one pair of latch arms, can be provided that attach to the housing 20.

Referring now to FIGS. 8-12, a connector assembly 10*a* is constructed in accordance with an alternative embodiment. As illustrated, the connector assembly includes an electrical connector 13*a* and a latch 70 that is configured to attach to the connector 13*a* and to the panel 12 to mount the connector 13*a* onto the panel 12. The connector 13*a* includes a connector housing 20*a*. In FIGS. 8-12, reference numerals identifying elements of connector 13*a* and housing 20*a* that correspond to like elements of connector 13 and housing 20 are denoted with like reference characters.

Figure 8:
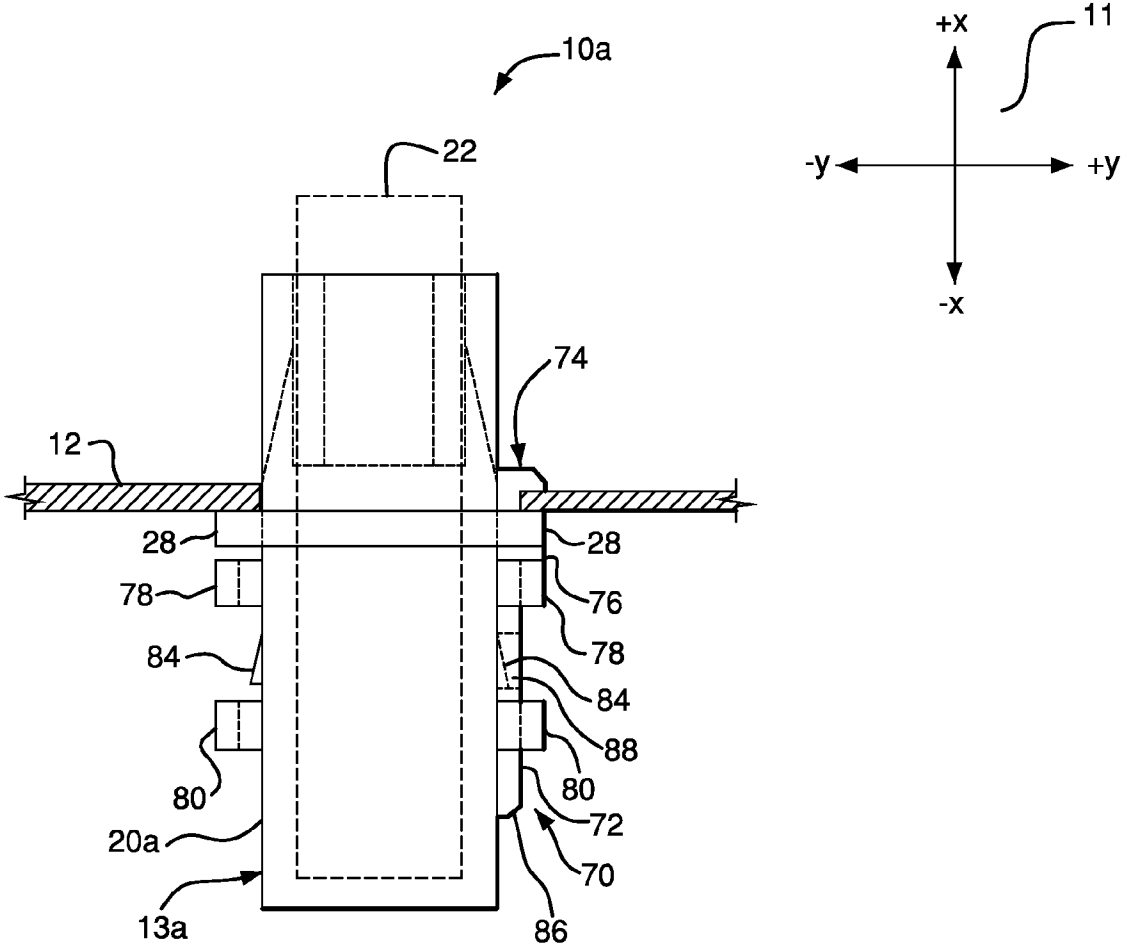
FIG. 8 is a top plan view of an electrical connector assembly including an electrical connector and a latch constructed in accordance with an alternative embodiment, with the connector assembly mounted on a panel and the latch in a fully-installed configuration.
Figure 9:
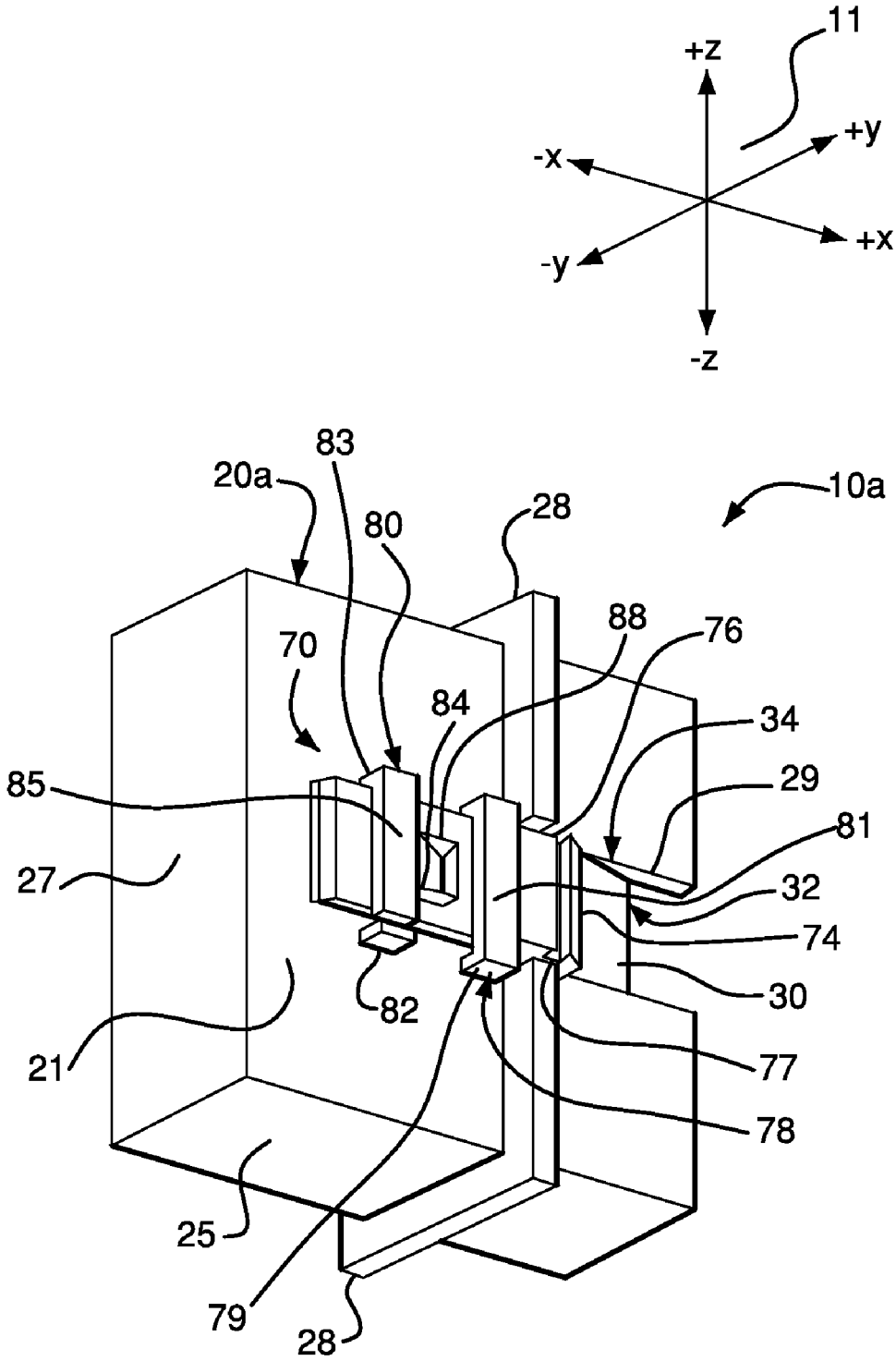
FIG. 9 is a rear perspective view of the electrical connector illustrated in FIG. 8, with the panel removed.

Referring to FIGS. 8-9, one side wall 21 is described, though it should be appreciated that the description can apply equally to both side walls 21 if a pair of latches 70 are desired. A substantially U-shaped bracket 78 is attached to the side wall 21 and includes a pair of outstanding legs 79 and a vertical cross beam 81 connected between the outer ends of the legs 79, and thus spaced from the side wall 21 to define an opening extending between the cross beam 81 and the side wall 21. A substantially L-shaped bracket 80 is also attached to the side wall 21, and includes an upstanding leg 83 and a cantilevered vertical beam 85 extending down from the leg 83 and spaced from the side wall 21 to define an opening between the beam 85 and the side wall 21. A projection 82 can be positioned adjacent the terminal end of the beam 85. Alternatively, the projection 82 could attach to the free end of beam 85 to define a U-shaped bracket. A wedge-shaped projection 84 can attached to the side wall 21, and flares outward away from the side wall in a rearward direction of travel.

The brackets 78 and 80, and projection 82 are positioned on the side wall such that the openings defined by the brackets 78 and 80 are aligned with the pocket 29 formed in the side wall 21. The projection 84 is positioned between the brackets 78 and brackets 80 in a front-rear direction, and is also in vertical alignment with the openings defined by the brackets 78 and 80. The brackets 78 and 80, and the projection 84 can retain the latch 70 on the housing 20*a*, as will now be described.

Figure 10:
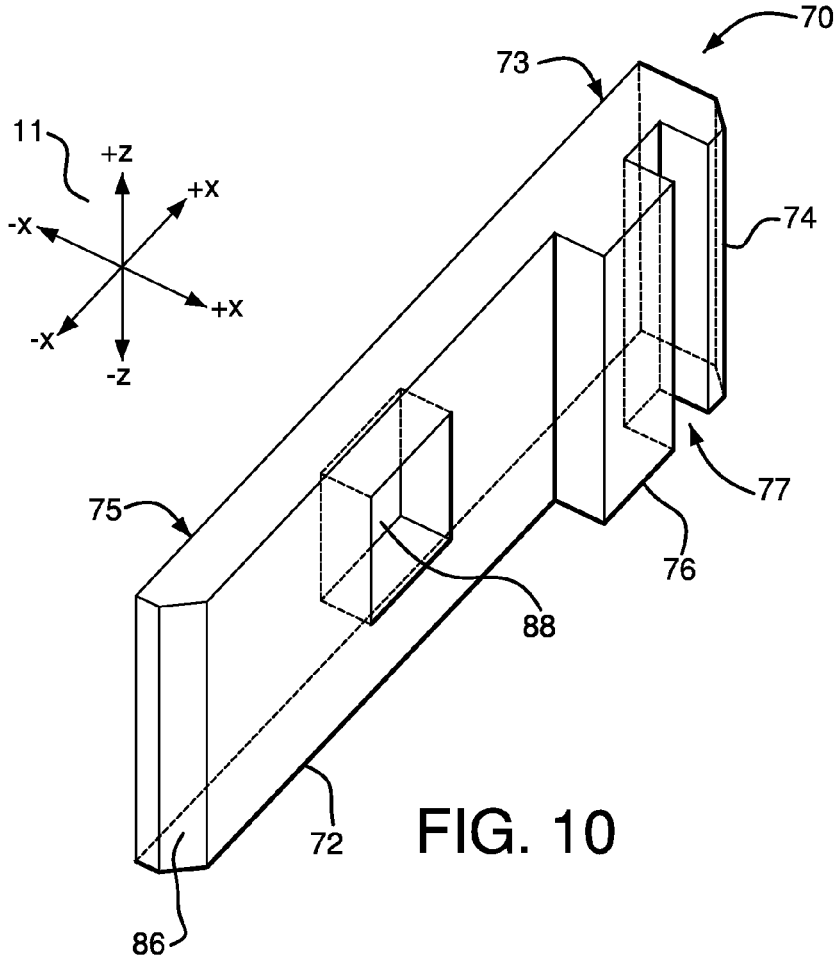
FIG. 10 is a rear perspective view of the latch illustrated in FIG. 9, depicting the latch in its fully-installed state.
Figure 11:
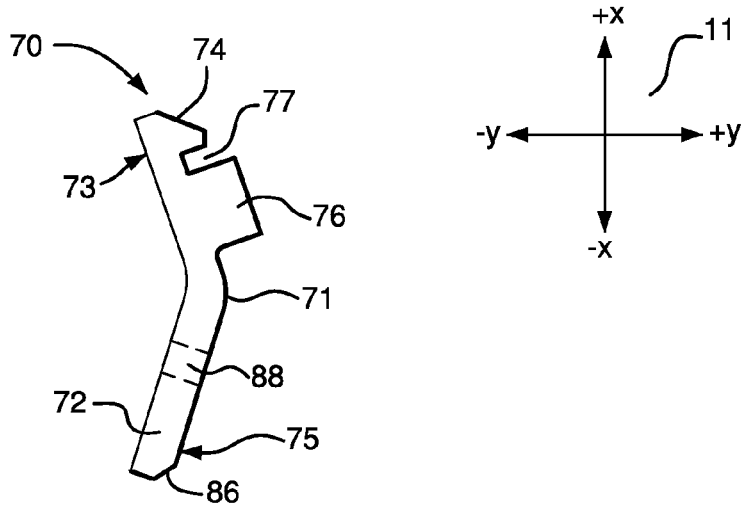
FIG. 11 is a side elevation view of the latch illustrated in FIGS. 9 and 10, depicting the latch in its uninstalled state.

Referring to FIGS. 10-11, the latch 70 can be formed from plastic, using an injection molding process. The latch 70 can be formed using other types of materials and processes in the alternative. The latch 70 can include a main portion 72 defining a front end 73, a rear end 75, and first and second projections 74 and 76, respectively, that extend out from the front end 73. The main portion 72 can include a bent elbow 71 that joins the front end 73 and rear end 75 such that the front and rear ends are angled with respect to each other when the latch 70 is in a relaxed, or unconstrained, state.

The first projection 74 is forwardly spaced with respect to the second projection 76 such that a gap 77 is defined between the projections 74 and 76. The projections 74 and 76 thus provide an engagement member in the form of a catch defined by the gap 77 that is configured to engage the panel 12 when the connector assembly 10*a* is mounted on the panel 12. The first projection 74 can be shorter than the second projection 76, such that the first projection 74 extends out from the front end 73 a distance less than that of the second projection 76. The front end of the first projection 74 can be beveled. It should be appreciated that the projections 74 and 76 can alternatively extend out from any location along the latch 70 to facilitate attachment of the connector assembly 10*a* to the panel 12. The latch further defines an opening 88 extending through the rear end 75 of the main portion 72. The opening is sized to receive the wedge shaped projection 84.

Figure 12:
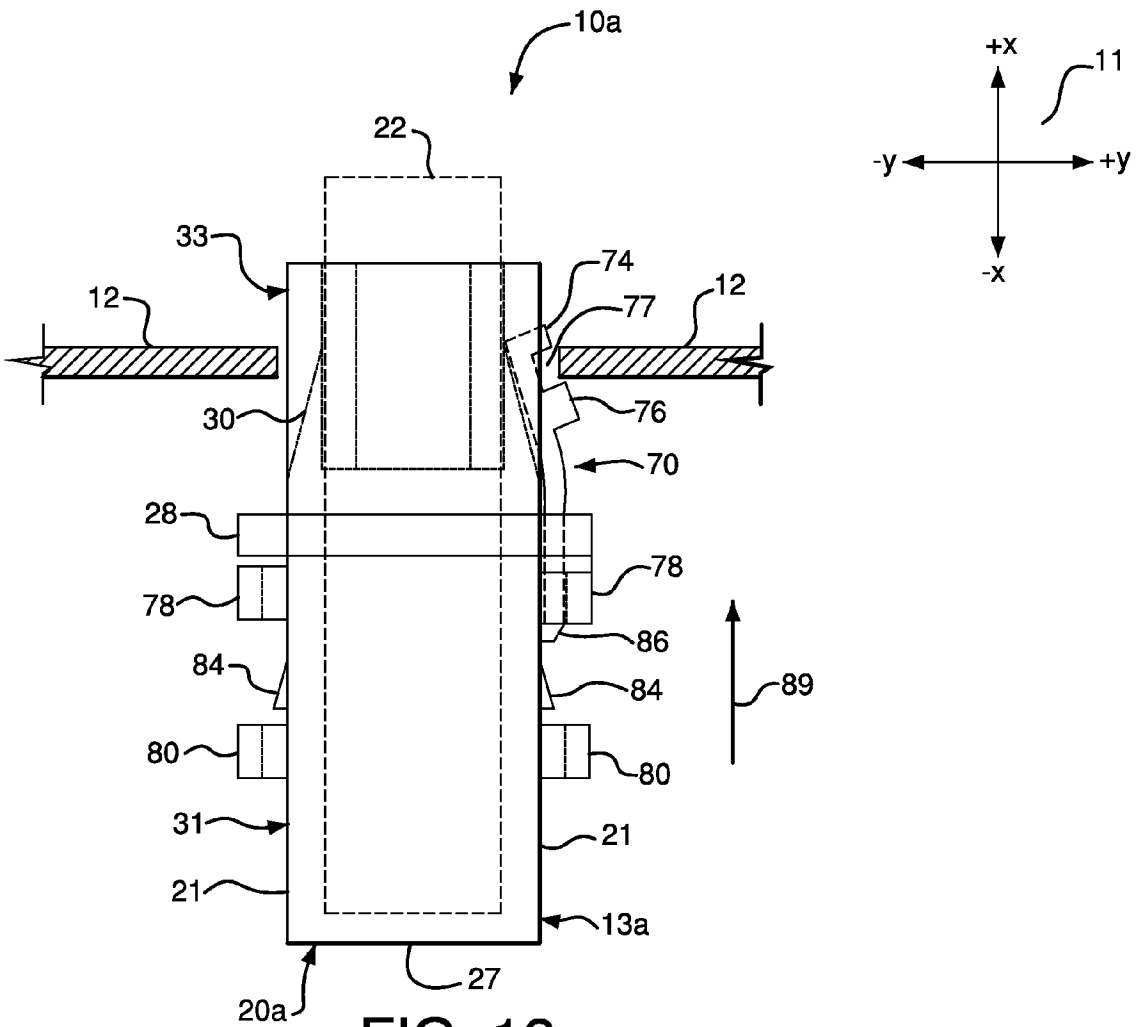
FIG. 12 is a top plan view of the electrical connector and panel illustrated in FIG. 8 as the electrical connector is mounted on the panel and the latch is in a pre-load position.

Referring now to FIG. 12, each latch 70 can be initially placed on the housing 20*a* in an initial, or "pre-load" position before the connector 13*a* is mounted on the panel 12. In particular, the latch 70 can be placed in its pre-load position by aligning the rear end 75 of the latch 70 with the recess 32 and the notch 34, and moving the latch 70 in the rearward ("−x") direction so that the rearward end of the latch 70 passes through the gap 34, and through the bracket 80. The bent profile of the main portion 72 of the latch 70 causes the forward portion of the latch 70 to rest against the angled guide wall 30 at the bottom of the associated recess 32.

Referring now to FIGS. 8 and 12, the connector 13*a* can be mounted on the panel 12 once the latch 70 has been placed in its pre-load position on the housing 20*a*. In particular, the connector 13*a* is positioned behind the panel 12, and is aligned with the opening 16 in the panel 12. The connector 13*a* can then be initially moved toward the panel 12, in the forward direction as denoted by the arrow 89 FIG. 12, until the forward-most portion of the housing 20*a* passes through the opening 16.

The first projection 74 of the latch 70 is aligned to fit through the opening 16, while the longer second projections 76 is aligned with the panel 12 and catches the edge of the panel 12 proximate the opening 16 as the latch 70 reaches the panel 12. The edge of the panel 12 is therefore in alignment with the catch 77. The interference between the projection 76 and the panel 12 prevents the latch 70 from being further inserted through the opening 16.

Because the front end of the latch 70 can terminate at a location rearward from the front end of the housing 20*a*, the front portion 33 of the housing 20*a* can pass through the opening 16 when the projection 76 engages the panel 12. Alternatively, the front end of the latch 70 can terminate at a position in front of the front end of the housing 20*a*, such that the front portion 33 does not extend through the opening 16 when the projection 76 first engages the panel 12.

When the latch 14 is engaged with the panel 12, further forward movement of the housing 20*a* in relation to the panel 12 causes the latch 14 to slide rearward in relation to the housing 20, such that the forward end of the latch 70 rides up the angled surface 30 of the housing 20*a*. The angled orientation of the surface 30 causes the forward end of the latch 70 to move outwardly, away from the housing 20*a*, so that the edge of the panel 12 proximate the proximate the latch 70 is captured by, i.e., becomes disposed within, the catch 77 defined by the first and second projections 74, 76.

Forward movement of the housing 20*a* in relation to the latch 70 also causes the rearward end of the latch 70 to ride up the wedge-shaped projection 86. The rearward edge of the latch 70 has an angled surface 86 that causes the rearward edge of the latch 70 to be captured between the bracket 82 and the underlying surface of the housing 20*a* as the edge moves upward and rearward.

The side of the projection 86 proximate the freestanding end of the substantially L-shaped bracket 80 of the housing 20*a* is higher than the other side of the projection 86, as shown in FIG. 9. The projection 86 thus causes the side of the latch 70 proximate the freestanding end of the bracket 80 to rise by a distance greater than the other side of the latch 70. The freestanding end of the bracket 80 can deflect to accommodate the relatively large deflection of the latch 70 caused by the high side of the projection 86. Continued rearward movement of the latch 70 in relation to the housing 20*a* eventually causes the projection 86 to become disposed within an opening 88 formed in the latch 70, as shown in FIGS. 8 and 9. The second projection 76 on the latch 70 is configured so that the second projection 76 contacts the forward edge of the bracket 78 as the projection 86 becomes disposed within the opening 88, as shown in FIG. 9. Interference between the bracket 78 and the second projection 76, and interference between the wedge shaped projection 86 and the portion of the latch 70 that defines the opening 88 prevents movement of the housing 20*a* relative to the latch 70 in the forward and rearward directions.

The restraining effect of the brackets 78, 80 on the latch 70 flattens the latch 70, i.e., bends the latch 70 from its original angled or knee-shaped profile, to a substantially flat profile as shown in FIGS. 8-10.

The latch 70 can be formed with a substantially flat profile in its uninstalled state in alternative embodiments. The height of the bracket 78 in such embodiments can be increased beyond that depicted in FIGS. 8-10, so that the latch 70 can be angled in relation to the housing 20*a* when the latch 70 is in its pre-load position.

The use of one latch 70 to secure the connector 13*a* to the panel 12 is disclosed for exemplary purposes only. Two latches 70 positioned on opposite sides of the housing 20*a* can be used in the alternative.

Figure 13:
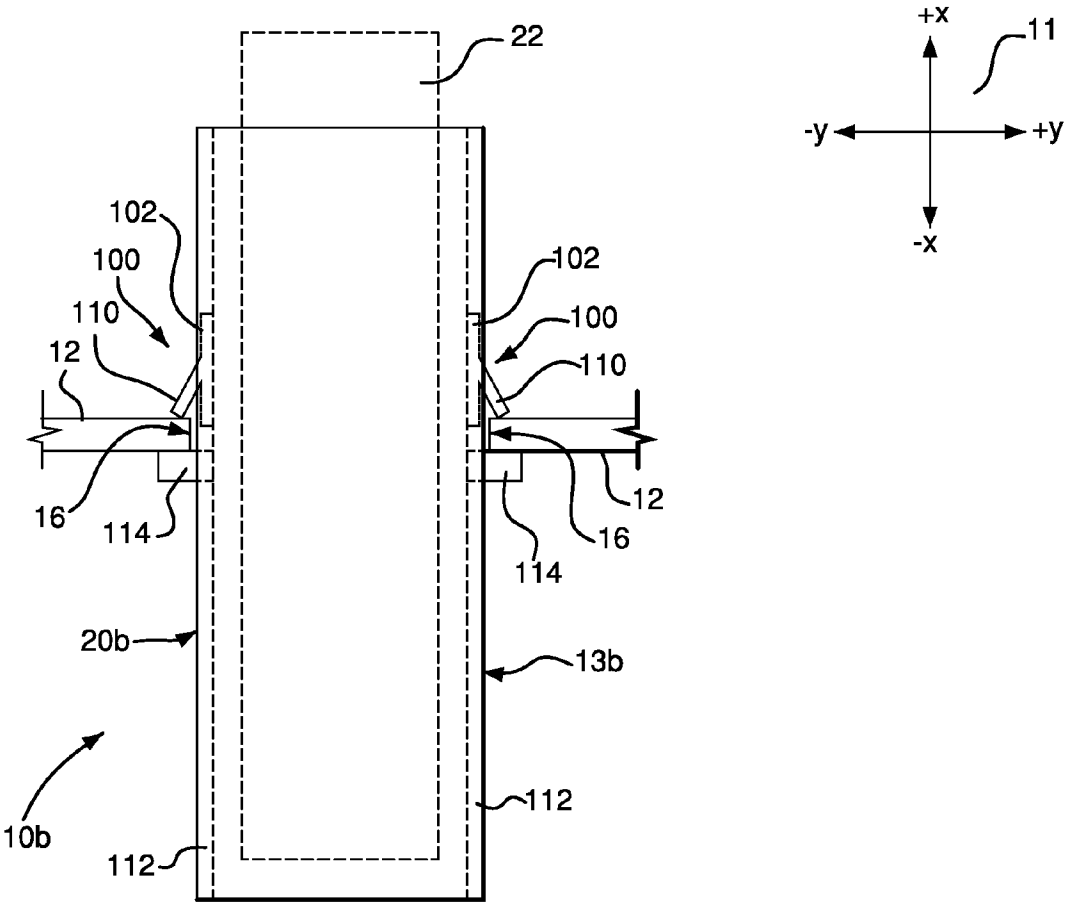
FIG. 13 is a top plan view of an electrical connector assembly including an electrical connector and a latch constructed in accordance with another alternative embodiment.
Figure 14:
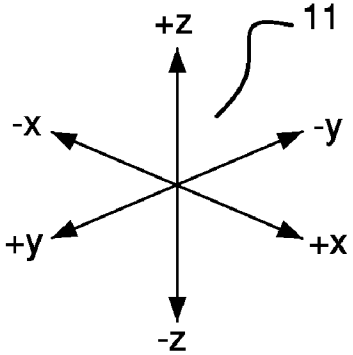
FIG. 14 is a front perspective view of a latch of the electrical connector illustrated in FIG. 13.
Figure 14:
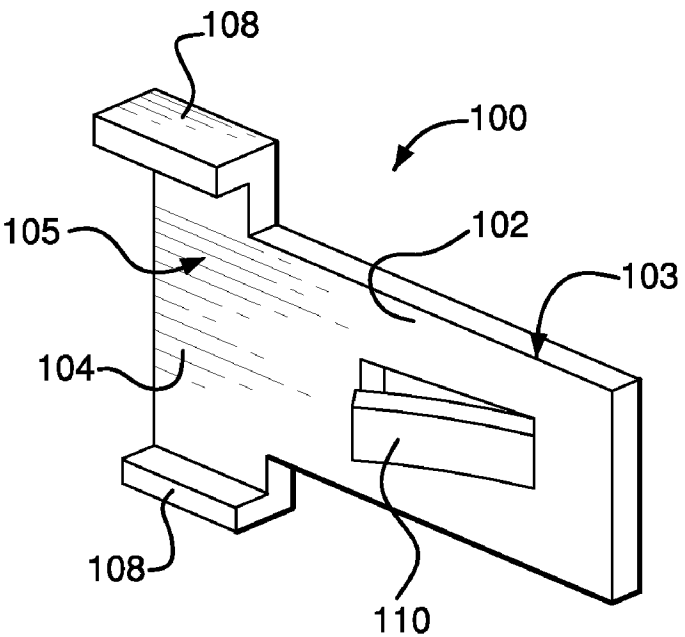
Figure 15:
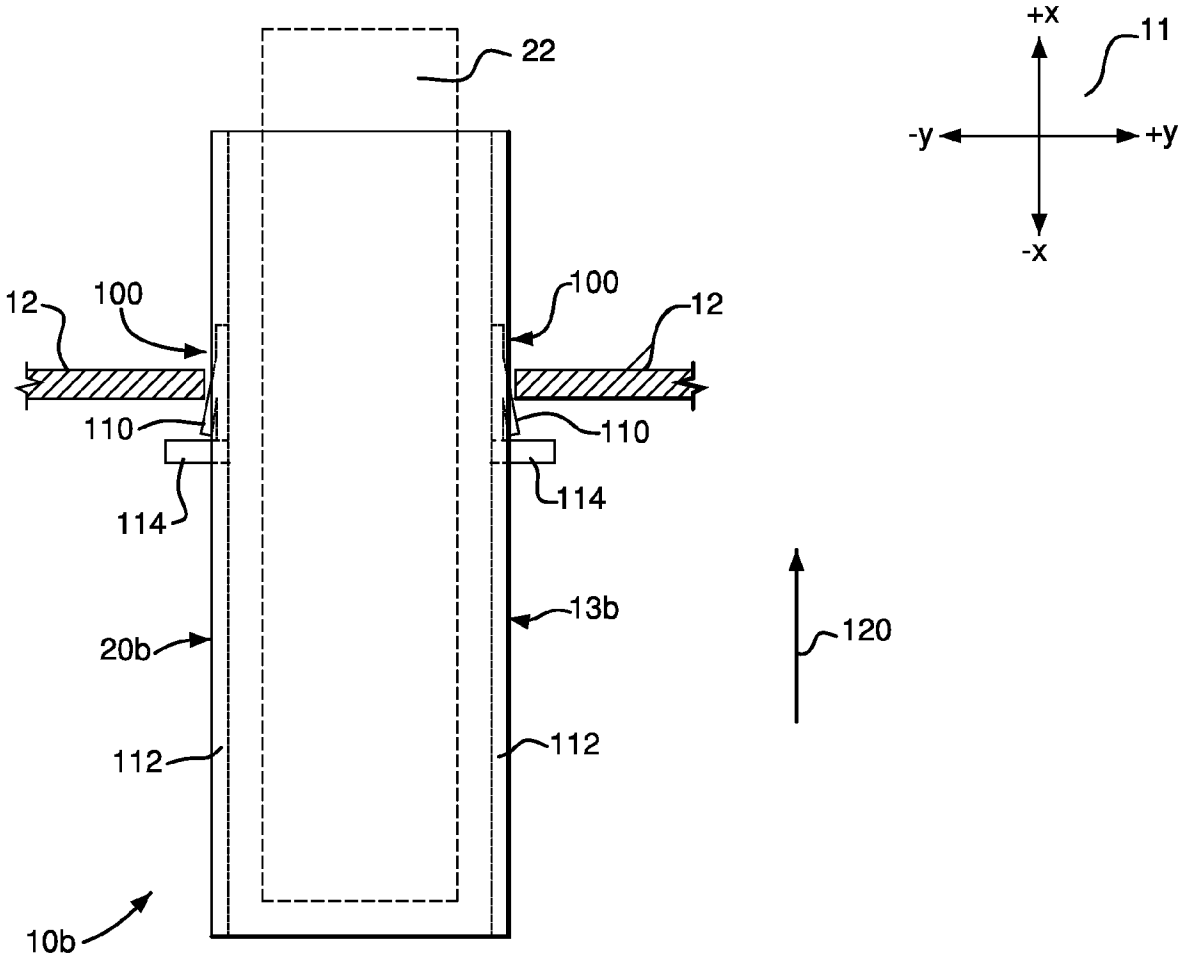
FIG. 15 is a top plan view of the electrical connector and panel illustrated in FIG. 13 as the electrical connector is mounted on the panel.

Referring now to FIGS. 13-15, a connector assembly 10*b* is constructed in accordance with an alternative embodiment. As illustrated, the connector assembly 10*b* includes an electrical connector 13*b* having a connector housing 20*b*, and a pair of latches 100 that are configured to attach to the connector 13*b* and to the panel 12 to mount the connector 13*b* onto the panel 12. In FIGS. 13-15, reference numerals identifying elements of connector 13*b* and housing 20*b* that correspond to like elements of connector 13 and housing 20 are denoted with like reference characters.

Referring to FIG. 14, the latches 100 can be formed from a metallic material such as stainless steel, or any alternative suitable material. Each latch 100 defines a front end 103 and a rear end 105. The latch 100 includes an elongate main portion 102, and a transverse portion 104 that extends out from the main portion 102 at the rear end 105 of the latch 100. Each latch 100 also includes two tabs 108 that extend out (in the "+y" direction) from the outer ends of the transverse portions 104.

Each latch 100 also includes a projection or tongue 110 joined at its forward end to the main portion 102 at the front end 103 of the latch 100. The tongue 110 extends out from the main portion 102, so that the rear end of the tongue 110 is spaced apart from the main portion 102.

Referring now to FIG. 13, the connector housing 20*b* defines a recess or channel 112 formed in each side wall configured to receive an associated one of the latches 100. The housing 20*b* does not include the recesses 32 or the angled surfaces 30 of the housing 20 of the connector 10. Each channel 112 can have a width ("z" dimension) that is slightly smaller than the length ("z"dimension) of the transverse portions 104 of the latches 100, so that each latch 100 is mounted on the housing 20*b* and retained in its associated channel 112 by an interference fit. The latches 100 can be retained in the channels 112 by other suitable means, such as adhesive or fasteners, in alternative embodiments.

The channels 112 are depicted as extending substantially the entire length of the housing 20*b*. The channels 112 can each extend a distance less than the entire length of the housing 20*b* in alternative embodiments.

A ledge or stop 114 can be inserted into each channel 112, immediately behind the latch 100. The stops 114 can be retained in the channels 112 by an interference fit or other suitable means. The stops 114 can be formed from plastic or other suitable materials.

The connector 13*b* can be mounted on the panel 12 by positioning the connector 13*b* behind the panel 12, and substantially aligning the connector 13*b* with the opening 16 in the panel 12. The connector 13*b* can be moved in the forward ("+x") direction toward the panel 12, in the direction denoted by the arrow 120 in FIG. 15, so that the forward end of the connector 13*b* becomes disposed within the opening 16.

The tip-to-tip distance between the rearward ends of the tongues 110 can be greater than the width ("y" dimension) of the opening 16. Accordingly, continued movement of the connector 13*b* toward the panel 12 eventually causes the tongues 110 to contact the edges of the panel 12 that define the sides of the opening 16, as shown in FIG. 15. Additional movement of the connector 110 in the forward direction, in conjunction with the outwardly-angled orientation of the tongues 110, causes the tongues 110 to deflect inwardly.

Continued movement of the connector 13*b* in the forward direction eventually causes the tongues 110 to clear the panel 12. The resilience of the tongues 110 causes the tongues 110 to spring outward to their original orientations and grasp the panel 12 once the tongues 112 have cleared the panel 12, as shown in FIG. 13. The tongue 110 thus provides an engagement member configured engage the panel 12 when the connector assembly 10*b* is mounted onto the panel 12.

The stops 114 are positioned so that the stops 114 contact the rearward-facing side of the panel 12 immediately after the tongues 110 have cleared the panel 12. Interference between the stops 114 and the panel 12 prevents substantial forward movement of the connector 13*b* in relation to the panel 12. Interference between the rearward ends of the tongues 110 and the panel 12 prevents substantial rearward movement of the connector 13*b* in relation to the panel 12.

The latches 100, when configured as depicted in FIGS. 13-15, allow substantially no float, i.e., movement in the forward and rearward directions, between the connector 13*b* and the panel 12 after the connector 13*b* has been mounted on the panel 12. If desired, float can be provided by bending or folding the rearward ends of the tongues 112, to shorten the effective length of the tongues 112. Float can also be achieved by positioning the stops 114 further back in the channels 112 in relation to the latches 100 than.

The use of two of the latches 100 to secure the connector 13*b* to the panel 12 is disclosed for exemplary purposes only. A single latch 100 can be used in the alternative.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed:

1. An electrical connector assembly configured to be mounted on a panel, the electrical connector assembly comprising:

an electrical connector having a connector housing; and a latch including a latch arm that extends along the connector housing, the latch arm configured to engage the panel as the housing is initially inserted along an insertion direction through a panel opening, wherein the latch arm slides along the connector housing as the connector housing is further inserted through the panel opening along the insertion direction after the latch arm has engaged the panel.

2. The electrical connector assembly as recited in claim 1, wherein the housing defines a recess formed therein, and the latch arm is positioned at least in part within the recess and translates within the recess as the housing is further inserted through the panel opening after the engagement member has engaged the panel.

3. The electrical connector assembly as recited in claim 2, wherein the recess comprises an angled guide wall, the latch arm translates along the guide wall as the housing is further inserted through the panel opening, and the angled surface causes the latch arm to translate in a direction substantially perpendicular to the direction of insertion of the housing and into engagement with the panel.

4. The electrical connector assembly as recited in claim 3, wherein the latch arm comprises a first projection and a second projection, and a gap disposed between the first and second projections, and an edge of the panel is captured in the gap as the latch arm translates in the substantially perpendicular direction.

5. The electrical connector assembly as recited in claim 4, wherein the latch further comprises a pair of latch arms that grasp the housing as the housing is further inserted through the opening in the panel.

6. The electrical connector assembly as recited in claim 5, wherein each of the pair of latch arms comprises a projection that grasps an end of the housing as the housing is further inserted through the opening in the panel.

7. The electrical connector assembly as recited in claim 1, wherein the latch is restrained by the panel as the housing is further inserted through the opening in the panel.

8. The electrical connector assembly as recited in claim 1, wherein the housing comprises a wedge-shaped projection, and the latch defines an opening formed therein that receives the projection as the housing is inserted through the opening in the panel, and the wedge-shaped projection restrains the latch in relation to the housing.

9. The electrical connector assembly as recited in claim 1, wherein the latch arm comprises outwardly extending tongue that engages the panel once the connector housing has been moved through the panel opening.

10. The electrical connector as recited in claim 4, wherein the first projection is longer than the second projection.

11. An electrical connector assembly configured to be mounted on a panel, the electrical connector assembly comprising:

a connector housing; and a latch including:

a band mounted onto the housing;

a first arm extending in a first direction from the band, the first arm including a first engagement member configured to engage the panel;

a second arm extending in a second direction from the band, wherein the second direction is different than the first direction, and the second arm includes a second engagement member configured to engage the housing;

wherein movement of the housing in an insertion direction causes the first engagement member to engage the panel, and further causes the second engagement member to engage the housing.

12. The electrical connector assembly as recited in claim 1, wherein the latch further comprises a latch band that surrounds the connector housing, and first and second latch arms that extend from the latch band.

13. The electrical connector assembly as recited in claim 1, wherein the housing further comprises an outwardly projecting lip, and the band is positioned against the lip as the housing is initially inserted through the opening, and the band slides away from the lip as the housing is further inserted through the opening.

14. The electrical connector assembly as recited in claim 13, wherein the latch arm further comprises a projection that engages the panel after the housing has initially been inserted into the opening.

15. The electrical connector assembly as recited in claim 11, wherein the first and second arms extend substantially horizontally, and the first and second arms are vertically offset form each other.

16. The electrical connector assembly as recited in claim 11, wherein the further movement of the housing causes the first engagement member to capture the panel.

17. The electrical connector assembly as recited in claim 11, further comprising a third arm extending in the first direction from the band, the third arm opposing the first arm, wherein the initial movement of the housing causes the third engagement member to engage the panel.

18. The electrical connector assembly as recited in claim 11, wherein the second direction is substantially opposite the first direction.

19. An electrical connector assembly configured to be mounted on a panel, the electrical connector assembly comprising:

an electrical connector having a connector housing; and a latch including a latch arm that extends along the connector housing, the latch arm including a first projection and a second projection spaced form the first projection so as to define a gap therebetween, wherein the first projection is configured to engage the panel as the housing is initially inserted along an insertion direction through a panel opening, and the second projection is configured to engage the panel as the housing is further inserted along the insertion direction after the first projection has engaged the panel, such that the panel is retained in the gap.

20. The electrical connector assembly as recited in claim 19, wherein the first projection is longer than the second projection.

21. The electrical connector assembly as recited in claim 20, wherein the second projection is spaced forward of the first projection with respect to the insertion direction.

* * * * *